US006319087B1

(12) United States Patent
Ferrigno

(10) Patent No.: US 6,319,087 B1
(45) Date of Patent: Nov. 20, 2001

(54) VARIABLE PERFORMANCE TOYS

(75) Inventor: Albert Ferrigno, Floral Park, NY (US)

(73) Assignee: Fisher-Price, Inc., East Aurora, NY (US)

( * ) Notice: Subject to any disclaimer, the term of this patent is extended or adjusted under 35 U.S.C. 154(b) by 0 days.

(21) Appl. No.: 09/234,545

(22) Filed: Jan. 21, 1999

(51) Int. Cl.[7] ..... A63H 3/28
(52) U.S. Cl. ..... 446/297; 446/73; 206/758
(58) Field of Search ..... 446/73, 81, 297, 446/397, 404; 206/736, 758, 765, 775, 776, 777, 457, 815

(56) References Cited

U.S. PATENT DOCUMENTS

| | | | | |
|---|---|---|---|---|
| 3,142,130 | | 7/1964 | Weitzell . | |
| 4,348,191 | * | 9/1982 | Lipsitz et al. | 434/308 |
| 4,842,564 | * | 6/1989 | Gerold et al. | 446/297 |
| 5,172,806 | * | 12/1992 | Mickelberg | 206/45.31 |
| 5,283,567 | * | 2/1994 | Howes | 340/815.69 |
| 5,290,198 | * | 3/1994 | Nakayama | 446/297 |
| 5,411,138 | | 5/1995 | Klawiter . | |
| 5,442,986 | * | 8/1995 | Cota | 84/267 |
| 5,465,909 | | 11/1995 | Roth . | |
| 5,607,336 | * | 3/1997 | Lebensfeld et al. | 446/297 |
| 5,636,741 | | 6/1997 | O'Keefe . | |
| 5,718,335 | | 2/1998 | Boudreaux . | |
| 5,795,209 | | 8/1998 | Moore . | |
| 5,992,629 | * | 11/1999 | Gullord et al. | 206/459.1 |

* cited by examiner

*Primary Examiner*—Kien T. Nguyen
(74) *Attorney, Agent, or Firm*—Akin, Gump, Strauss, Hauer & Feld, L.L.P.

(57) ABSTRACT

A combination including a toy and a removable element inserted therein includes the toy having a generator and an actuator therewith. The actuator enables the generator to generate a sound or movement. An improvement of this combination includes the removable element being operably connected to the generator such that the removable element enables the generator to generate a first volume of the sound and removal of the removable element enables the sound generator to generate a second volume of the sound which is different from the first volume of the sound. Instead of or in addition to the removal of the removable element enabling the toy to generate a different volume of the sound, the removal of the removable element can enable the toy to emit a second duration of sound different from a first duration of sound and/or produce a second duration of a movement different from a first duration of a movement.

20 Claims, 5 Drawing Sheets

VARIABLE PERFORMANCE TOYS

BACKGROUND OF THE INVENTION

Toys which employ features such as emission of a sound or production of a movement upon activation of the toy are very popular with children, particularly young children and infants. One marketing approach that toy manufacturers have successfully used, generally referred to as a "try-me" feature, is to enable a potential purchaser to activate the feature while the toy is still packaged and on a store shelf, thus providing a sample of the feature that the toy will display during use.

In toys that emit a sound, the ambient noise level in a store where the toy is being sold may prevent the prospective purchaser from adequately hearing the sound which is being emitted, and/or the speaker which emits the sound may be covered or muffled by packaging which at least partially surrounds the toy, further preventing the prospective purchaser from adequately hearing the sound which is being emitted. If a toy is provided which produces a sound loud enough to be heard over ambient store noise and through the packaging, the sound would most likely be too loud for a small child, particularly an infant, to enjoy properly. Therefore, it would be beneficial to provide a toy which emits a sound which is loud enough to be heard through the packaging and the ambient noise in a store, yet which provides a lower volume of sound when being played with at home after being removed from the packaging so as not to be too loud for a small child to enjoy.

Still other toys employ try-me devices which operate a particular feature such as sound or movement for an abbreviated amount of time compared to the time that the feature operates in normal use. The consumer is required to activate a switch on the toy after the toy is removed from its packaging to activate the normal use feature. It would be beneficial to provide a toy which can operate for an abbreviated amount of time while in the packaging, and then, without any action on the part of the consumer apart from removing the toy from its packaging, operate the toy for a longer period of time after the toy is removed from the packaging.

BRIEF SUMMARY OF THE INVENTION

In one aspect, the present invention provides a combination including a toy and a removable element inserted therein. The toy has a sound generator and an actuator therewith. The actuator enables the sound generator to generate a sound. An improvement in this combination comprises the removable element being operably connected to the sound generator such that the removable element enables the sound generator to generate a first volume of the sound and removal of the removable element enables the sound generator to generate a second volume of the sound which is different from the first volume of the sound.

In another aspect, the present invention provides a combination including a toy and a removable element inserted therein. The toy has a sound generator and an actuator therewith. The actuator enables the sound generator to generate a sound. An improvement in this combination comprises the removable element being operably connected to the sound generator such that the removable element enables the sound generator to generate a volume of the sound for a first duration of time and removal of the removable element enables the sound generator to generate the volume of the sound for a second duration of time which is different from the first duration of time.

In yet another aspect, the present invention provides a combination including a toy and a removable element inserted therein. The toy has a motion generator and an actuator therewith. The actuator enables the motion generator to generate a visible movement of the toy. An improvement in this combination comprises the removable element being operably connected to the motion generator such that the removable element enables the motion generator to generate a visible movement of the toy for a first duration of time and removal of the removable element enables the motion generator to generate a visible movement of the toy for a second duration of time which is different from the first duration of time.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
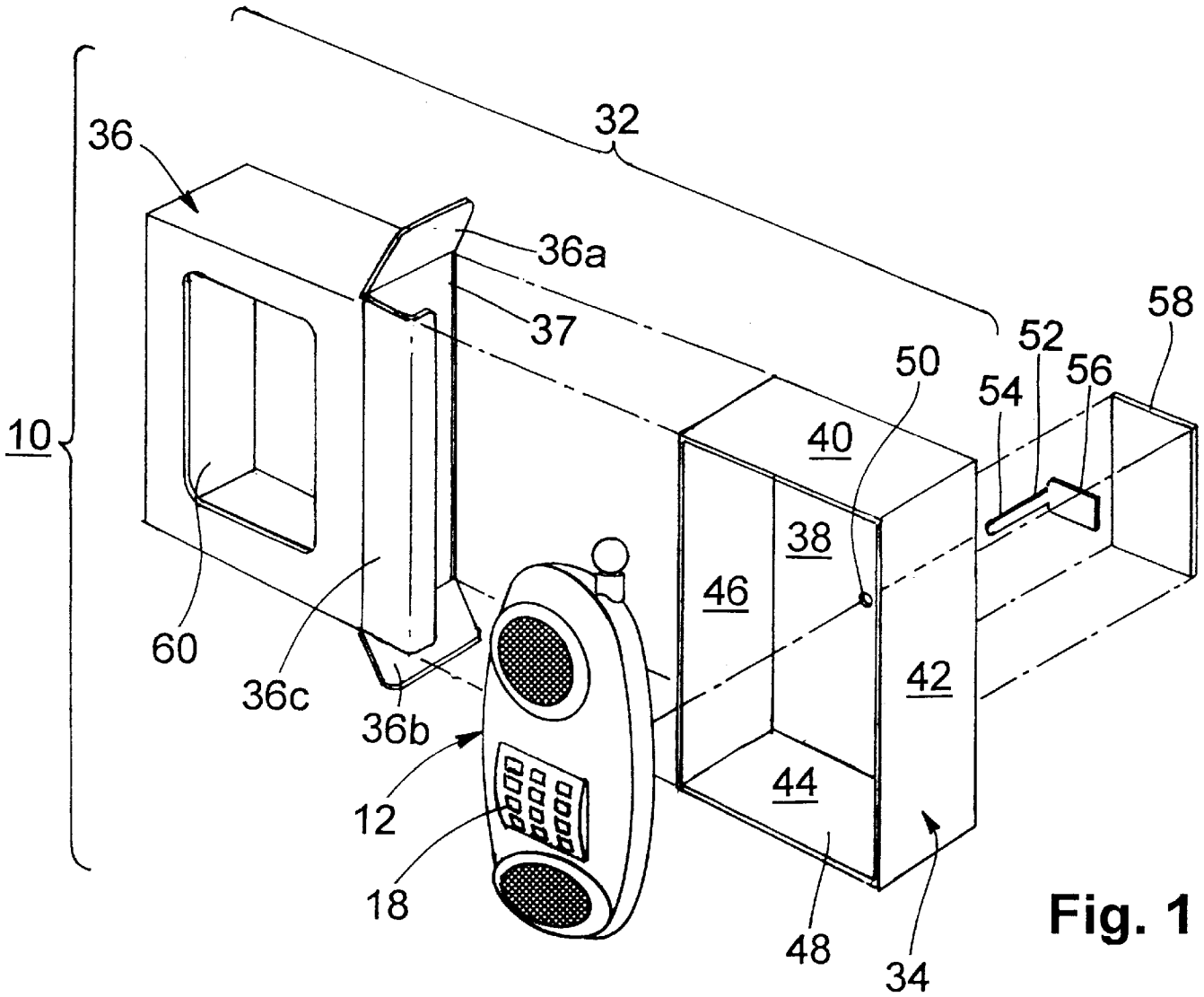
FIG. 1 is an exploded perspective view of a sound-producing toy of the present invention.

Certain terminology is used in the following description for convenience only and is not limiting. The words "right," "left," "lower" and "upper" designate directions in the drawings to which reference is made. The words "inwardly" and "outwardly" refer to directions towards and away from, respectively, the geometric center of the device and designated parts thereof. The terminology includes the words specifically mentioned above, derivatives thereof and words of similar import.

In the drawings, like numerals are used to indicate like elements throughout. Referring to FIG. 1, there is shown an exploded perspective view of a combination 10 of the present invention, including a toy 12. Although FIG. 1 depicts a portable telephone as the toy 12, those skilled in the art will realize that other types of toys, such as musical boxes and any other toy that generates or emits a sound, can be used.

Figure 2:
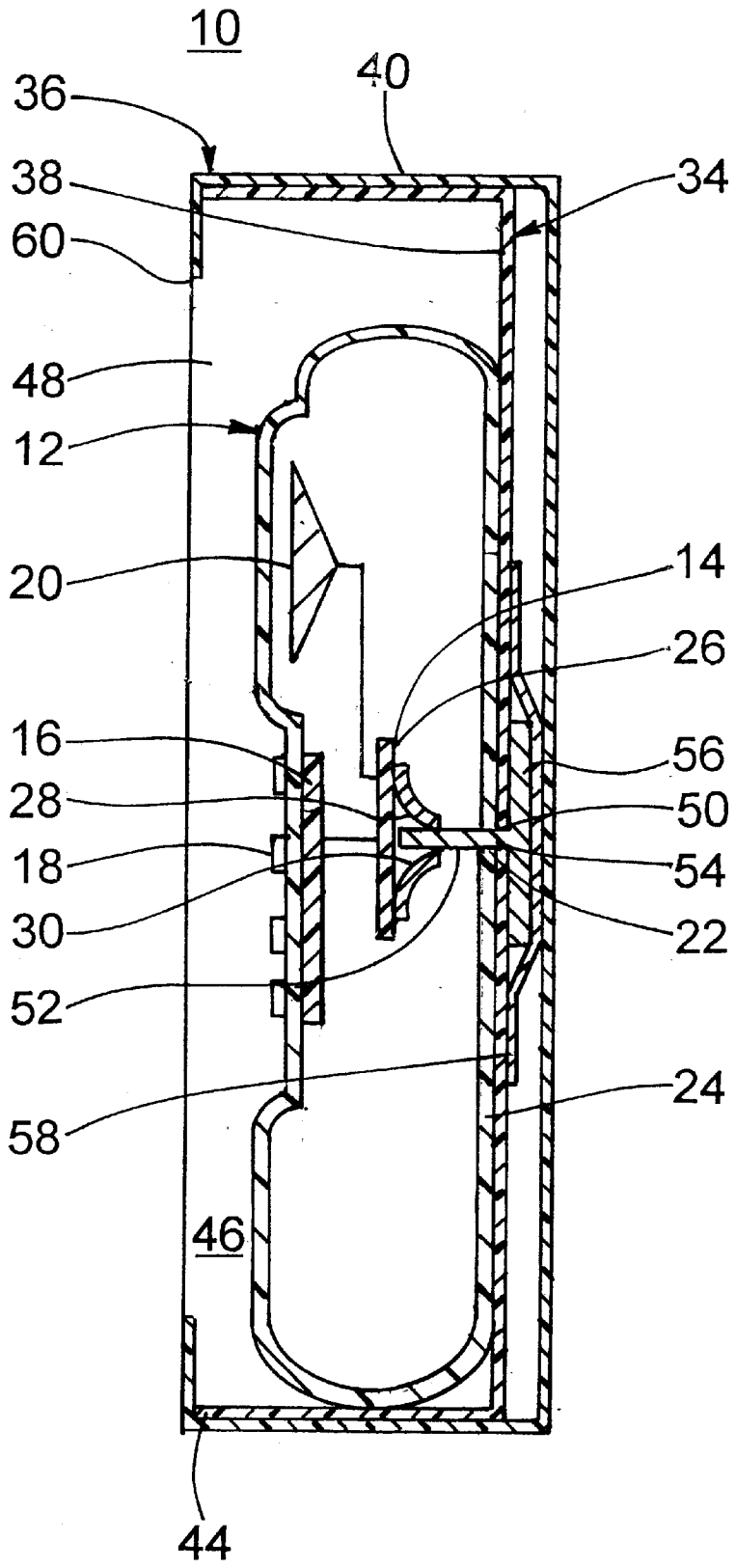
FIG. 2 is a profile view, in section, of the sound-producing toy of the present invention.

The toy 12 has a sound generator 14 and an actuator 16, seen in FIG. 2. In the portable telephone depicted in FIG. 1, the actuator 16 includes a plurality of buttons 18 on a telephone keypad, although those skilled in the art will realize that any of a multitude of other forms of actuators may be used for toy telephones and other toys. Although twelve buttons 18 are shown in FIG. 1, those skilled in the art will realize more or less than twelve buttons 18 can be used and that not all buttons 18 need be part of actuator 16. Buttons 18 can operate a single switch in common (not depicted) to generate only one sound by the telephone or each button or subset of buttons may operate separate switches (not depicted) in the actuator 16 or may be directly wired into inputs of the sound generator 14. Additionally, those skilled in the art will realize that other features on the toy 12 instead of and/or including buttons 18 can be used as an actuator 16. The actuator 16 is operably connected to the sound generator 14 in a manner well known to those skilled in the art to activate the sound generator 14. The sound generator 14 is operably connected to a speaker 20 located within the toy to generate or emit a sound from a signal generated by the sound generator 14. Actuation of the actuator 16 enables the sound generator 14 to emit audible sound from the speaker 20.

As shown in FIG. 2, the sound generator 14 includes a circuit board 26. The circuit board 26 includes two contact elements 28, 30. Preferably, at least one battery (not shown) is located within the toy 12 and provides power to operate the sound generator 14, the actuator 16 and the speaker 20. Preferably, AA, AAA C, D, 9V or "button" batteries are used to power the toy.

Still referring to FIG. 2, the toy 12 has a hole 22 located therein for reasons that will become apparent. Preferably, the hole 22 is located in the rear 24 of the toy 12, although those skilled in the art will realize that the hole 22 can be located at other places on the toy 12.

Referring back to FIG. 1, packaging 32, which includes a box insert 34 and an outer cover 36, is sized to at least partially surround the toy 12. The outer cover 34 is preferably a retail carton with indicia on at least one, preferably more than one, and most preferably, all sides, which advertises and describes the product which is encompassed therein. Preferably, the box insert 34 has a rear wall 38 and a plurality of sides 40, 42, 44, 46 that at least partially surround the toy 12. The box insert 34 has at least one accessible, preferably open side 48, preferably a front side, that permits manual access to the actuator 16 when the toy 12 is placed within the box insert 34. Those skilled in the art will realize that the box insert 34 can be provided in other configurations without departing from the spirit and scope of the present invention. For example, the open side 48 need not be entirely open. The open side 48 needs only be open enough to allow a user (not shown) to manually activate the actuator 16 when the toy 12 is in the box insert 34. Alternatively, side 48 could be covered, for example, with a flexible, transparent plastic film (not indicated) which deflects sufficiently to permit buttons 18 to be depressed through the film, or which has a hole cut therethrough sized sufficiently to permit buttons 18 to be depressed.

The toy 12 is inserted into the box insert 34, preferably through the open side 48, such that the toy 12 is removably retained by the box insert 34. Those skilled in the art will realize that the toy 12 can be secured to the box insert 34 by conventional means, such as by string, rubber bands, wire or plastic ties, staples and the like (not shown), although the toy 12 need not be secured to the box insert 34. Those skilled in the art will also realize that the box insert 34 need not be used, and the toy 12 can be affixed directly to the outer cover 36.

The box insert 34 also preferably includes an element opening 50 through which a removable element 52 is inserted. Preferably, the removable element 52 is in the form of a flexible tape. The removable element 52 includes an elongated portion 54 and a head 56. Preferably, the element opening 50 is located on a side of the packaging 32 opposite from the open side 48, although those skilled in the art will realize that the element opening 50 may be located on other sides of the box insert 34 but preferably so as to adjoin the hole 22 of the toy.

The toy 12 is inserted into the box insert 34 in such a manner that the hole 22 is aligned with the element opening 50. The elongated portion 54 is inserted through the element opening 50 and the toy hole 22 as shown in FIGS. 1 and 2. The elongated portion 54 separates contacts 28 and 30 in the toy from each other, opening a first electrical circuit and enabling the sound generator 14 to generate a first volume of sound through a second electrical circuit upon actuation of the actuator 16. The element opening 50 is sized so that the head 56 cannot fit through the element opening 50. Preferably, the removable element 52 is flexible enough to allow the elongated portion 54 to bend, allowing the head 56 to be positioned flush against the rear wall 38 after the elongated portion 54 is inserted into the toy 12. Preferably, an adhesive strip 58 is affixed over the head 56 to adhere the removable element 52 to the rear wall 38. However, those skilled in the art will realize that the adhesive strip 58 is not required, although with the adhesive strip 58, the removable element 52 is retained by the box insert 34. Additionally, those skilled in the art will realize that the removable element 52 can be adhered to the rear wall 38 on a side proximate to the toy 12, eliminating the need for the element opening 50. In the alternative where the box insert 34 is not used, the removable element can be adhered directly to the outer cover 36 in any manner known to those skilled in the art.

Preferably, after the removable element 52 is inserted into the toy 12, the box insert 34 containing the toy 12 and the removable element 52 is inserted through an opening 37 in the outer cover 36 which is sized to permit the box insert 34 to be inserted into the outer cover 36. Preferably, the outer cover 36 has three closable flaps 36*a*, 36*b*, and 36*c* which can be closed after the box insert 34 is inserted into the outer covering 36 to retain the box insert 34 in the outer covering 36. However, those skilled in the art will realize that the outer cover 36 is not absolutely required, and that an outer covering, if used, may be designed to be closed and/or opened differently from cover 36. The outer cover 36 has an opening 60 which corresponds to the open side 48 of the box insert 34 and enables the user to manipulate the actuator 16 through the opening 60 of the outer cover 36 and the open side 48 of the box insert 34. The cover opening 60 communicates with the open side 48 of the box insert 34, thus permitting manual access to the actuator 16 when the toy 12 is in the box insert 34 and outer cover 36.

Figure 3:
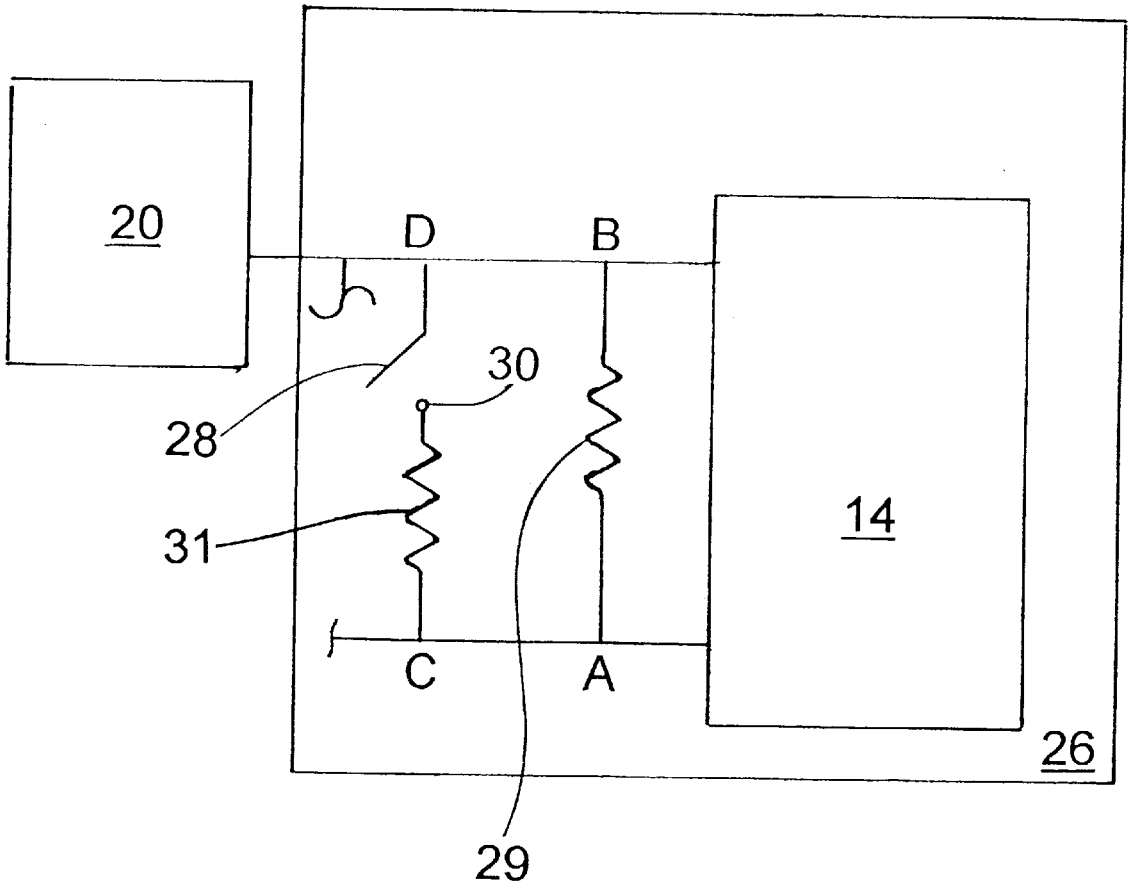
FIG. 3 is a partial schematic view of a circuit board of the sound-producing toy of the present invention.

When the toy 12 is displayed for sale, a prospective purchaser (not shown) can generate a sound from the toy 12 by reaching through the cut out 60 in the outer cover 36, through the open side 48 of the box insert 34, and by operating the actuator 16. The actuator 16 actuates the sound generator 14, enabling the toy 12 to generate a first volume of sound through the speaker 20. As shown in FIG. 3, contacts 28 and 30 are separated, opening electrical path C-D. A signal generated by the sound generator 14 travels along electrical path A-B and through only resistor 29 before going to the speaker 20. The sound produced by the sound generator 14 permits the prospective purchaser to determine what sound the toy 12 will emit during normal use.

To activate the improvement feature of the present inventive concept, the box insert 34 is removed from the outer cover 36. The retaining elements, such as string, rubber bands, plastic ties, wire, staples and the like (if any), are removed from the toy 12, and the toy 12 is then removed from the box insert 34. Upon removal of the toy 12 from the box insert 34, the removable element 52 is automatically removed from the toy 12 and the removable element 52 is retained by the box insert 34.

Removal of the removable element 52 from the toy 12 allows the contact elements 28, 30 to contact each other, completing electrical path C-D through resistor 31. Preferably, resistor 31 has less resistance than resistor 29. For example, resistor 31 has a resistance of 2.5K ohms and resistor 29 has a resistance of 3.9K ohms. The signal splits through electrical path C-D and electrical path A-B, enabling the sound generator 14 to generate a second volume of sound which has a different volume from the first volume of sound. Preferably, the first volume of sound is louder than the second volume of sound. More preferably, the first volume of sound is approximately 85 decibels and is at least approximately 10 decibels louder than the second volume of sound. The word "approximately" as used herein is defined to mean plus or minus twenty percent. However, those skilled in the art will realize that other decibel values and ranges can be used without departing from the spirit and scope of the present invention.

Preferably, the sound generator 14 is enabled to generate only the second volume of sound after the removable element 52 is removed from the toy 12. The preferred removable element 52 of a tape is pliable enough to prevent the user from reinserting the removable element 52 into the toy hole 22 and separating the contacts 28, 30.

In an alternate embodiment, the removable element 52 is operably connected to the sound generator 14 such that the insertion of the removable element 52 separates contacts 28, 30. In this condition, an electrical path is formed which enables the sound generator 14 to generate a first volume of the sound for a first duration of time. Removal of the removable element 52 allows contacts 28, 30 to contact each other. The circuit board is configured such that, when the contacts 28, 30 contact each other, a different electrical circuit is formed, enabling the sound generator 14 to generate a second volume of sound for a second duration of time. "Different" with respect to electrical circuits means at least different operationally. Preferably, the second duration of time is longer than the first duration of time. Those skilled in the art will realize that circuit boards which enable sound generators to generate sound for different durations of time are known. Those skilled in the art will also realize that the first volume of sound can be the same as or a different volume than the second volume of sound.

Figure 4:
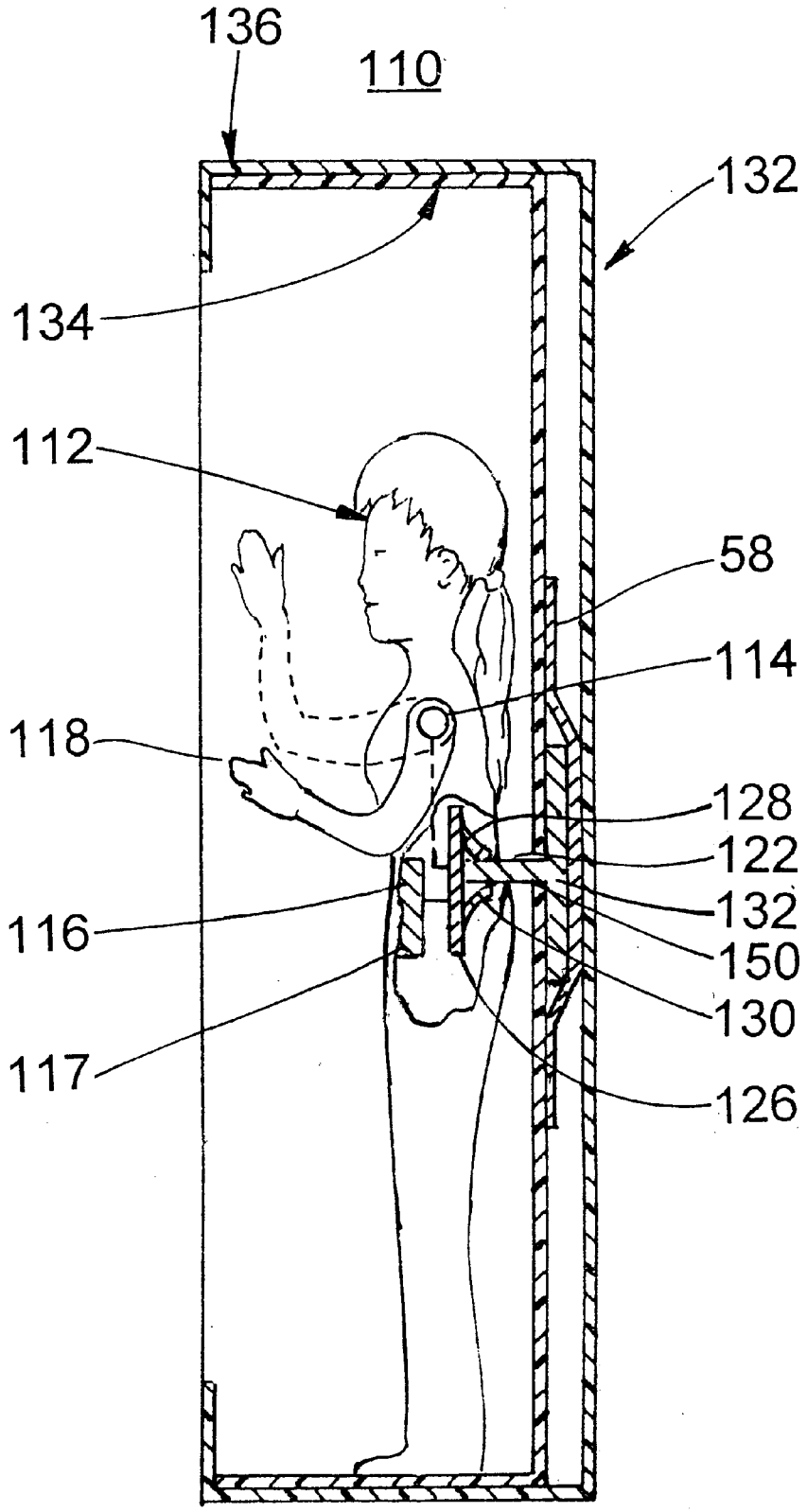
FIG. 4 is a profile view, partially in section, of a movement-producing toy of the present invention.

In yet a third embodiment, shown in FIG. 4, the toy 112 is one which exhibits some type visible movement instead of emitting a sound. The toy 112 is depicted as a doll, but those skilled in the art will realize that other types of toys which exhibit movement can be used. The presently depicted toy 112 includes a motion generator 114 and an actuator 116 which enables the motion generator 114 to generate movement. The actuator 116 is operably connected to a circuit board 126. The circuit board 126 is operably connected to the motion generator 114 in a manner well known to those skilled in the art. Two contacts 128, 130 are mounted to the circuit board 126.

The toy 112 is shown with a movable arm 118, although those skilled in the art will realize that other types of toys and other movable parts can be used. The arm 118 is movable from a first position (shown in solid lines) to a second position (shown in phantom lines) and back to the first position, repeating the motion over a period of time.

The toy 112 is inserted into packaging 132 which is similar to packaging 32 in the first embodiment. The packaging 132 has a box insert 134 and an outer cover 136. While the toy 112 is in the packaging 132, the actuator 116, in this instance, the toy's stomach 117, can be actuated. A removable element 152 is inserted into the toy 112 through a toy hole 122 in the toy 112 and an element opening 150 in the box insert 132. The removable element 152 separates the contacts 128, 130. Batteries (not shown) power motion generator 114, the actuator 116, and the circuit board 126.

Upon actuation, the actuator 116 sends a signal to the circuit board 126. The circuit board 126 then sends a signal to the motion generator 114, moving the arm 118. The arm motion is repeated for a first duration of time, for example, between four and seven seconds, although those skilled in the art will realize that other time durations can be used. When the toy 112 is removed from its packaging 132, the removable element 152 is removed from the toy 112 in the same manner as the removable element 52 is removed from the toy 12 as disclosed above. Removal of the element 152 allows the two contacts 128, 130 to contact each other and complete an electrical, path enabling the motion generator 114 to generate the motion for a second duration of time longer than the first duration of time. Preferably, the second duration of time is between fifteen and twenty seconds, although those skilled in the art will realize that other time durations can be used.

Similar to the first embodiment, after the removable element 152 is removed from the toy 112, the removable element 152 preferably cannot be reinserted into the toy 112, and the toy 112 will operate for only the second duration of time.

Figure 5:
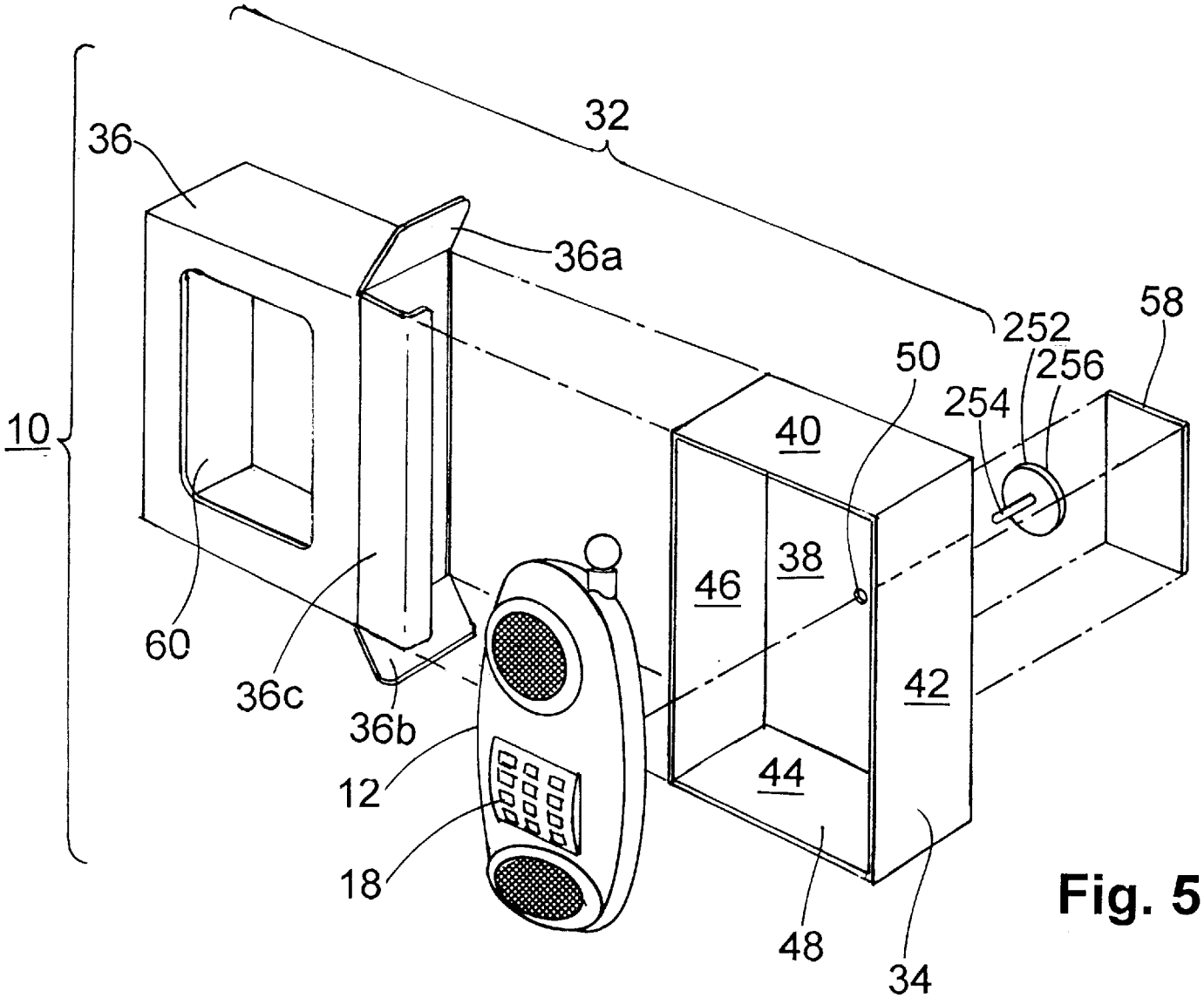
FIG. 5 is an exploded perspective view of an alternate embodiment of the sound-producing toy of the present invention.

Although the preferred removable element 52, 152 is a flexible tape, those skilled in the art will understand that other types of removable elements, such as a pin 252 with an elongated portion 254 and a flat head 256 (shown in FIG. 5), can be used instead of the flexible tape, without departing from the scope of the invention.

The above-disclosed combinations might be used with any type of powered sound generating or moving toy. For example, in dolls, stuffed animals and/or action figures, a part of the body of such a toy, such as a hand, a foot, and/or a stomach can be pressed or squeezed and the toy can emit sound such as a giggle, a cry, a yell or word(s), and/or the toy can generate a visible movement, such as limb or body movement. Additionally, a toy vehicle, such as a police car, a fire engine, a race car, and/or other types of vehicles can use the combination as well to move or generate a sound. In these types of toys, a part of the vehicle can be pressed, such as a light bar on the roof, and a sound such as a siren or an engine revving can be produced or a propulsion part of the toy moved. Other toys, such as crib toys, musical boxes and/or learning games can have buttons that are pushed to emit sounds such as a voice, animal sounds or music. These types of toys and features are merely examples of the types of toys that can employ the removable element and are not meant to be limiting.

Although the embodiments disclosed above only either emit a sound or exhibit a motion, those skilled in the art will realize that a toy which both exhibits a motion and emits a sound can be developed without departing from the spirit and scope of the present inventive concept.

It will be appreciated by those skilled in the art that changes could be made to the embodiments described above without departing from the broad inventive concept thereof it is understood, therefore, that this invention is not limited to the particular embodiments disclosed, but it is intended to cover modifications within the spirit and scope of the present invention as defined by the appended claims.

What is claimed is:

1. In a combination including an amusement device having a sound generator therein, a speaker electrically coupled with the sound generator, a power supply of at least one battery providing power to at least the sound generator, and an actuator positioned on the device so as to be manually activated by a user of the device, the actuator further being operatively coupled with the sound generator such that manual activation of the actuator by a user activates the sound generator to generate sound through the speaker, an improvement wherein the device is configured such that a mechanical element is removably extended into the device from outside the device and is operatively coupled in the device with the sound generator such that when the mechanical element is operatively coupled with the sound generator and the sound generator is activated by manual activation of the actuator, the sound generator generates sound through the speaker in a first volume and, when the mechanical element is removed from the device and the sound generator is activated by manual activation of the actuator, the sound generator generates sound through the speaker at a second volume different from the first volume.

2. The combination according to claim 1 wherein the sound generator generates a first sound in the first volume and a second sound in the second volume and wherein the first sound is different in duration than the first sound.

3. The combination according to claim 2 wherein the first sound is shorter in duration that the second sound.

4. The combination according to claim 1 wherein the mechanical element is a substantially rigid pin.

5. The combination according to claim 1 wherein the mechanical element is a substantially flexible strip.

6. The combination according to claim 1 wherein the device further comprises a circuit configured to operatively couple the mechanical element with the sound generator.

7. The combination of claim 6 wherein the circuit includes a resistance added between the speaker and the power supply in the device when the mechanical element is removed from operative coupling with the sound generator through the circuit.

8. The combination of claim 6 wherein the circuit couples a resistance with the speaker in the device when the mechanical element is removed from the device to lower the speaker output from the first volume to the second volume.

9. The combination according to claim 1 further comprising packaging removably retaining the device, the packaging providing manual access to the actuator, and the mechanical element being coupled with the packaging sufficiently securely such that removal of the device from the packaging removes the mechanical element from the device.

10. The combination according to claim 9 wherein the sound generator is enabled to generate sound at only the second volume after the device is removed from the packaging.

11. The combination according to claim 1 wherein the sound generator is enabled to generate sound at only the second volume after the mechanical element is removed from the device.

12. The combination according to claim 1 wherein the first volume of the sound is at least approximately ten decibels louder than the second volume of the sound.

13. In a combination including an amusement device having a sound generator therein, a speaker electrically coupled with the sound generator, a power supply of at least one battery providing power to at least the sound generator, and an actuator positioned on the device so as to be operated by a user of the device, the actuator further being operatively coupled with the sound generator such that operation of the actuator by a user activates the sound generator to generate one or more sounds through the speaker, an improvement wherein the device is configured such that a mechanical element is removably extended into the device from outside the device and is operatively coupled in the device with the sound generator such that when the mechanical element is operatively coupled with the sound generator and the sound generator is activated by manual activation of the actuator, the sound generator generates sound through the speaker for a first period of time and, when the mechanical element is removed from the device and the sound generator is activated by manual activation of the actuator, the sound generator generates sound through the speaker for a second period of time different from the first period of time.

14. The combination according to claim 13 wherein the first period is shorter than the second period.

15. The combination according to claim 13 wherein the device further comprises a circuit configured to operatively couple the mechanical element with the sound generator.

16. The combination according to claim 13 further comprising packaging removably retaining the device, the packaging providing manual access to the actuator, and the mechanical element being coupled with the packaging sufficiently securely such that removal of the device from the packaging removes the mechanical element from the device.

17. The combination according to claim 16 wherein the first period of sound has a first volume and wherein the second period of sound has a second volume different from the first volume and wherein the sound generator is enabled to generate only the second volume after the device is removed from the packaging.

18. The combination according to claim 13 wherein the first period of sound has a first volume and wherein the second period of sound has a second volume different from the first volume.

19. The combination according to claim 18, wherein the sound generator is enabled to generate only the second volume after the mechanical element is removed from the device.

20. The combination according to claim 18, herein the first volume of the sound is at least approximately ten decibels louder than the second volume of the sound.

* * * * *